United States Patent [19]

Dismond, III

[11] Patent Number: 5,051,967

[45] Date of Patent: Sep. 24, 1991

[54] RANDOMLY SELF-ADVANCING TIMEPIECE

[76] Inventor: Samuel R. Dismond, III, 366 California Ave., Ste. 24, Palo Alto, Calif. 94306

[21] Appl. No.: 626,978

[22] Filed: Dec. 13, 1990

[51] Int. Cl.[5] ..... G04C 19/00; G04C 17/00

[52] U.S. Cl. ..... 368/62; 368/82; 368/223

[58] Field of Search ..... 368/10, 62, 82–84, 368/223, 239–242

[56] References Cited

U.S. PATENT DOCUMENTS 4,698,783 10/1987 Nishimuro et al. ..... 368/10 X 4,712,923 12/1987 Martin ..... 368/10

4,833,661 5/1989 Kim ..... 368/80

*Primary Examiner*—Vit W. Miska

[57] ABSTRACT

A microprocessor based timepiece capable of displaying a plurality of time information having one display (117) that continuously shows a time that is fast and varies within a user-specified range, and a second display (118) that is momentarily activated to show the actual time. The timepiece has a mode switch (113) for selecting the operating mode of the microprocessor, a set switch (114) for setting the actual time and inputting a desired range of fastness, and a time switch (115) for momentarily displaying the actual time.

20 Claims, 5 Drawing Sheets

RANDOMLY SELF-ADVANCING TIMEPIECE

BACKGROUND

1. Field of the Invention

This invention relates to time keeping mechanisms, specifically those that display a plurality of time information.

2. Description of the Prior Art

Heretofore, the advancement of the art of time keeping mechanisms has included devices and inventions mechanical, electromechanical, and electronic that improve the function of keeping time accurately. There has been innovation to decrease the amount of, or apply correction to, the error that occurs in these devices as they keep time. Individuals and firms hence have competed to produce the most accurate timepieces. This competition to produce accuracy has been directly and indirectly aided by the advancements in the arts of unrelated fields such as metallurgy, manufacturing, mechanical design, electronics, microelectronics, and microprocessor design. The fruits of this competition and collective advancement have been timepieces with time-keeping errors that are measured in fractions of a second per month.

Although trophies of human ingenuity, these super-precise instruments surpass ergonomic requirements. That is, the ratio of marginal utility to the marginal increase in accuracy becomes infinitesimal when considering contemporary timepieces. Humans typically estimate both the time of day and the amount of time it takes to complete tasks in quanta of minutes. In fact, most individuals function quite well by considering time in quanta of five minutes. The quest for accuracy has produced recent advancements that satisfy the aesthetic needs of individuals who wish to master the art of measuring time and the art of creating measuring devices. However, this quest has not produced timepieces that are that much more useful to humans in the way they think about time. That this aesthetic advancement has no real significance is evidenced by the commercial reality of super-precise movements in analog timepieces that lack numerical dials. Resolution of the actual time in minutes is often not possible with timepieces of this design.

The development of alarming timepieces represent an ergonomic advancement. The concept is ancient, and innovation has produced novel alarming methods. But aside from this progress, the art of time keeping has not advanced in directions that help humans in their presently evolved attitudes towards time measurement.

An unpublished study by the author has identified a significant proportion of the population that set their timepieces fast. One reason for this behavior is that certain people chronically underestimate the amount of time it takes to complete a given task. Some individuals typically underestimate by five to ten minutes, the length of time it takes to perform a task. Therefore, they find that they are habitually late by this same amount. In response, these people set their timepieces fast by the interval that they perceive that they are typically late by. For a short time they may be fooled by this maneuver. They believe that the fast time is the correct time. Hence when they are typically late by the fast time, they are punctual by the actual time. Some respondents in the study reported that they enjoy discovering the extra time to squeeze in more tasks before a deadline.

The present invention exemplifies a new and unobvious art of a randomly self-advancing timepiece that aides time management for individuals that enjoy setting their timepieces ahead. The invention features two displays for time information. The first display is continuously active and shows a time that is always fast. Furthermore, the amount by which this display reads fast varies randomly within a range that is specified by the user. The second display can be momentarily activated to indicate the actual time.

OBJECTS AND ADVANTAGES

Several objects and advantages of the present invention are:

(a) To provide a randomly self-advancing time piece.

(b) To provide a timepiece described above where one of the displays always reads fast.

(c) To provide a timepiece where a second display can be momentarily activated to display the actual time.

(d) To provide a timepiece described above where the display that always reads fast does so by an amount that lies within a range.

(e) To provide a timepiece as described above where the user can specify the range.

(f) To provide a timepiece described above where the display that always reads fast does so by having a randomly chosen amount from the specified range added to the correct time.

(g) To provide a timepiece described above where the display that always reads fast does so by an amount that randomly varies with time within the user-specified range.

Further objects and advantages include a timepiece that has a display that reads fast by some amount that randomly varies within a user-specified range, thereby preventing the user from consciously or unconsciously correcting the displayed. The user realizes the advantage of being more punctual by relying on the continuous display. When the user operates in a usual fashion that typically causes tardiness by some amount (n), the user simply specifies the minimum of the fastness range as being (n). Since the continuous display is fast by some random amount equal to at least (n) or more, the user will be punctual with respect to the actual time.

DRAWING FIGURES

Other objects and advantages of the present invention and a full understanding thereof may be had by referring to the following detailed description and claims taken together with the accompanying illustrations. The illustrations are described below in which like parts are given like reference numerals in each of the drawings.

DRAWING REFERENCE NUMERALS

111—Bezel (or case)
112—Wrist strap (or band)
113—Mode switch
114—Set switch
115—Time switch
116—Display
117—"Fast" time display
118—Actual time display
119—Microprocessor
120—Read-only memory
121—Random-access memory
122—Arithmetic logic unit
123—Input-output controller
124—Computing section
125—Timing crystal
126—Counter/timer section
128—Timing capacitor

DESCRIPTION AND OPERATION

Figure 1:
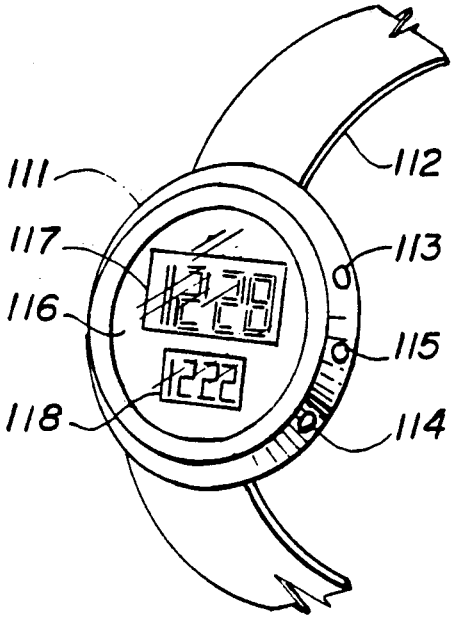
FIG. 1 shows a perspective-elevation view of a preferred embodiment of the device according to the invention.

Referring now to the drawings, with particular attention to FIG. 1, there is shown an embodiment of the device that clearly demonstrates the present invention consisting of a dual liquid crystal display watch.

Figure 2:
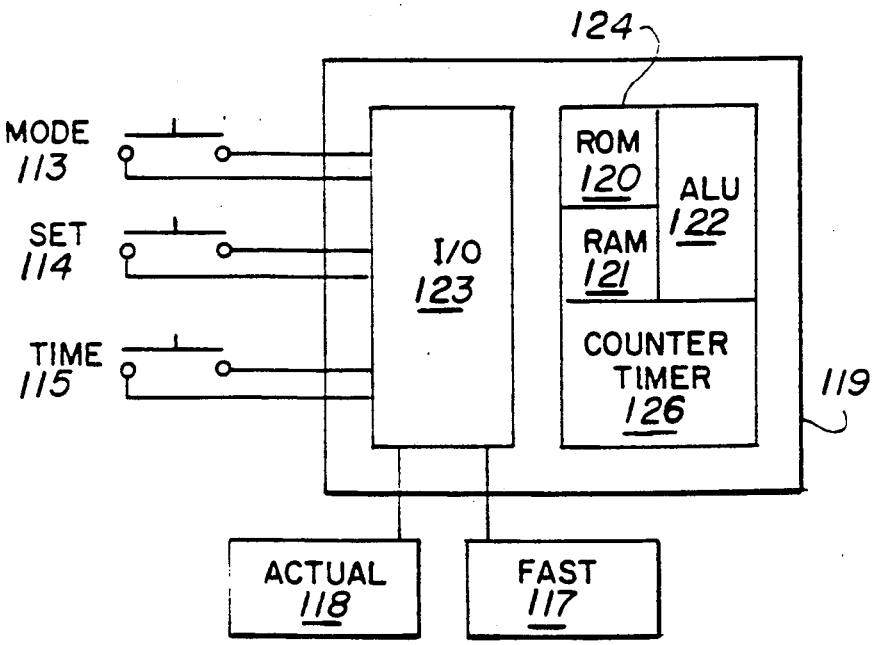
FIG. 2 shows a block diagram of the electrical components of the device according to the invention.

The embodiment consists of a case or bezel 111, and a wrist strap or band 112. Protruding from the perimeter of the bezel 111 are three push switches, 113, 114, 115 which are operated by the user in order to perform time-setting and function selection. On the face of the device is a display 116 which consists of two liquid crystal time displays: the actual time display 118, and the "fast" time display 117. The bezel also houses a microprocessor 119 FIG. 2, which contains the electronic elements required to generate the functions of the device.

Returning now to FIG. 1, mode switch 113 allows the user to select between the time-setting functions of setting the actual time, setting the low offset range, and setting the high offset range. Set switch 114 is operated to advance the value displayed on the actual time display 118 during the set mode. Time switch 115 is activated to momentarily display the actual time on the actual time display 118.

The actual time display 118 displays time only during one of the time setting functions initiated by set switch 114, or when the time switch 115 is activated; otherwise it remains blank. The "fast" time display 117 displays continuously a time which is offset by a time variable amount between the low offset and high offset values designated by the user through operation of the mode switch 113 and the set switch 114.

Referring again to FIG. 2, the microprocessor 119 has an input-output controller 123 connecting switches 113, 114, and 115 and displays 117 and 118 to a computing section 124 having an arithmetic and logic unit 122, a read-only memory 121, a random-access memory 120, and a counter/timer 25. The microprocessor periodically samples the value of the counter/timer section 125 to determine the actual time based on user values stored in the random-access memory 120 during the setting process. The microprocessor then selects a random time offset from the read-only memory, based on the actual time and the user offsets stored in the random-access memory 120 during the setting process, supplements the correct time accordingly, and displays the result on the "fast" time display 117.

Figure 3A:
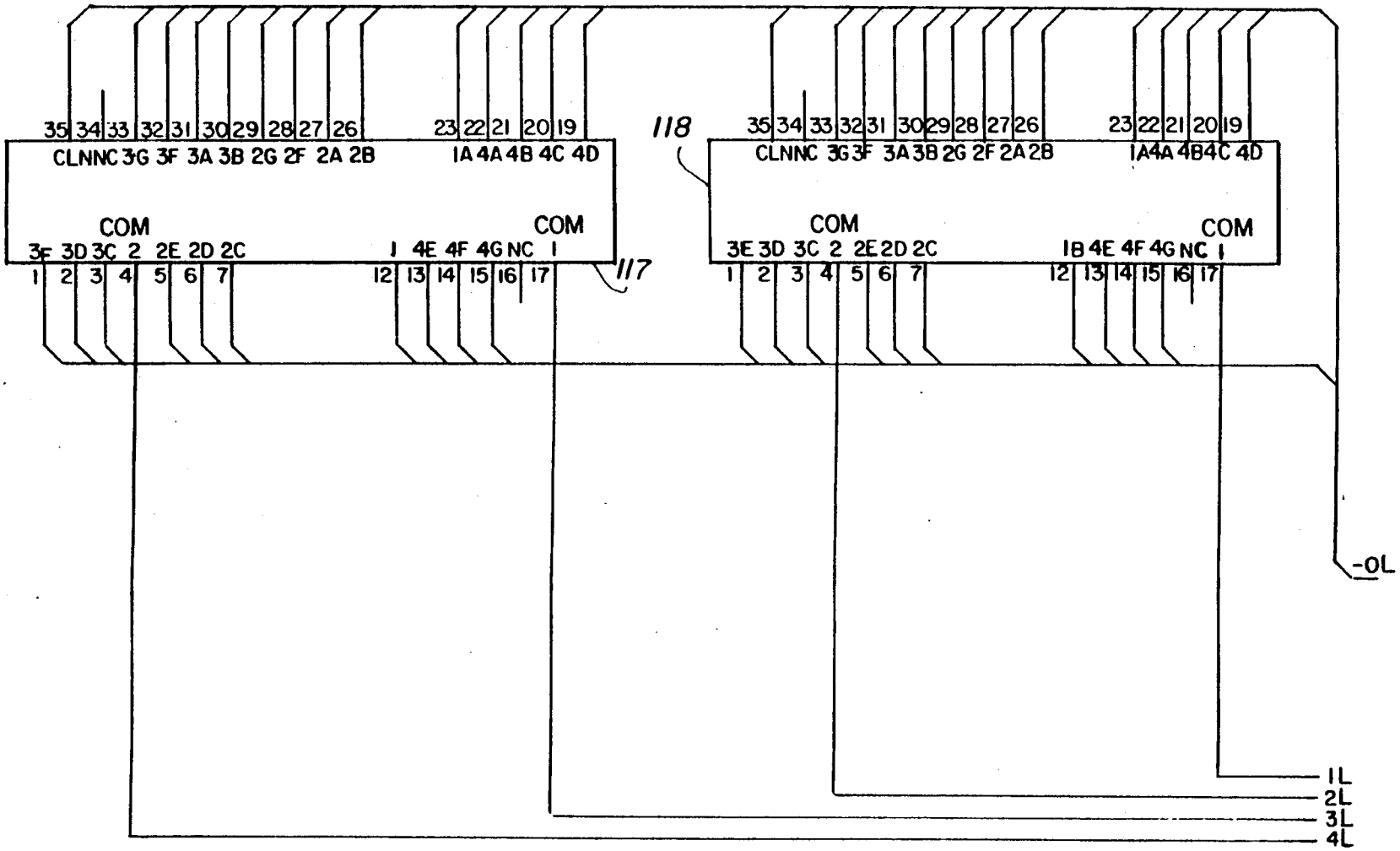
FIG. 3A is a detailed schematic of the electronic circuitry of the liquid crystal displays of the device according to the invention. Wire leads represented by 0L,1L,2L,3L,4L and 5L correspond to the same wire leads on FIG. 3B.
Figure 3B:
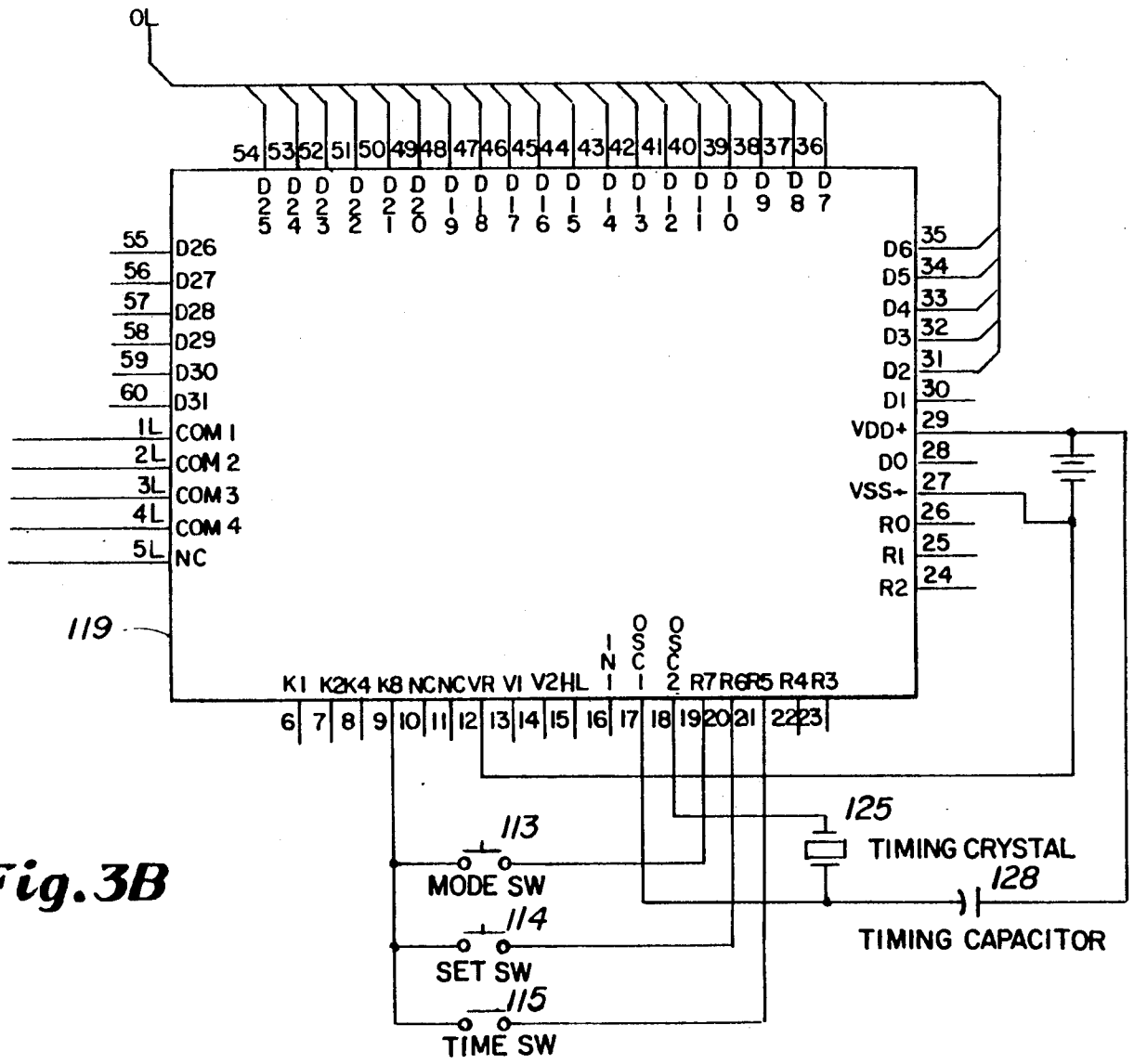
FIG. 3B is a detailed schematic of the electronic circuitry of the microprocessor of the device according to the invention.

Referring to FIG. 3, the embodiment can be readily implemented using a single-chip large-scale integrated circuit microprocessor 119 as the main computing device. An SMC1112 single chip microcomputer with display driver manufactured by SMOS Systems, Inc., is suitable for use as the microprocessor 119, and contains the input-output controller 123, and the computing device 124, diagrammed in FIG. 2. Liquid crystal displays 17 and 18 are driven by the input-output controller 23 of the microprocessor 119. Crystal 125 and capacitor 128 form a timing circuit to control the internal operation of the microprocessor 119. The microprocessor 119 monitors the state of the switches 113, 114, and 115 by sequentially energizing its outputs R5–R7 while monitoring its input K8. Thus, when output R5 is energized, the device can determine whether or not time switch 115 is actuated by reading whether or not input K8 is energized. Similarly, the microprocessor 119 can determine the states of mode switch 113, and set switch 114.

The microprocessor is readily programmed in a manner described in the SMC1112 technical manual published in 1982 by SMOS Systems, Inc. to perform the functions necessary to display an actual time and a "fast" time so to meet the objects and advantages of the present invention. Flow charts outlining the programming of the microprocessor 119 are contained in FIG. 4 and FIG. 5.

Figure 4:
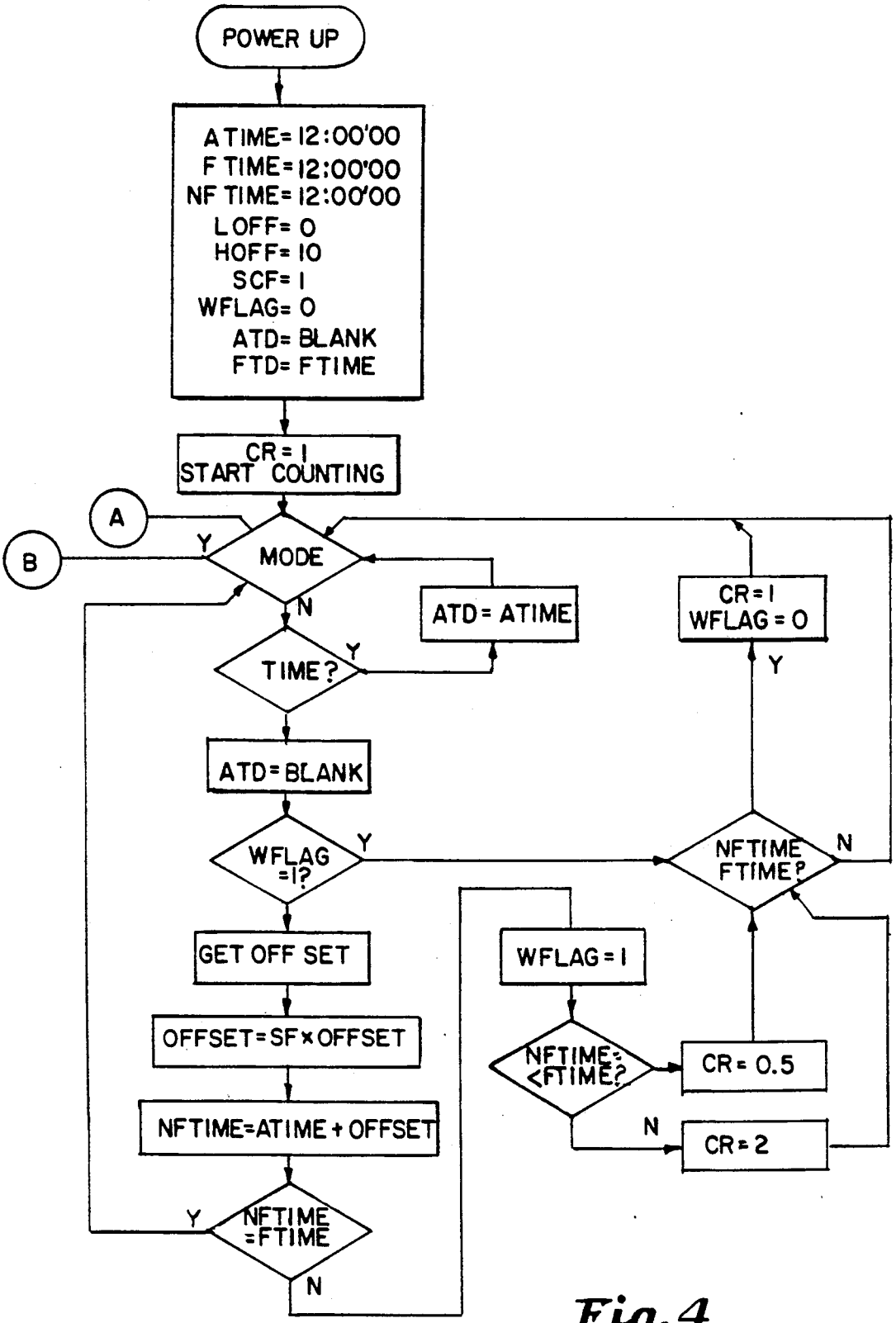
FIGS. 4 and 5 are logical flow charts illustrating the functions performed by the microprocessor controlling the operation of the device and displaying the time according to the invention.

Referring to FIG. 4, when the device is put in operation by installation of a battery, the microprocessor 119 is initialized as follows: the counters ATIME, or actual time, FTIME, or fast time, and NFTIME, or next "fast" time, are set to 12:00 noon. The variable LOFF, or lowest desired offset for the "fast" time, is set to zero minutes, and the variable HOFF, or highest desired offset for the "fast" time, is set to ten minutes. SCF, a scaling factor for the offset which allows use of one table for all offset ranges, is set to one. WFLAG, a flag indicating that a process is pending, is set to zero. The ATD, or actual time display 118 is blanked, and the FTD, or "fast" time display 117, is set to display the "fast" time FTIME. CR, the counting rate for FTIME is set to one, meaning it will advance at the same rate as ATIME. Then the counters FTIME, ATIME, and NFTIME are started counting at the usual rate used for telling time.

The microprocessor 119 now tests the status of mode switch 113. If the mode switch is not actuated, processing proceeds per FIG. 4. If the mode switch is actuated, processing branches to the setting routines diagrammed in FIG. 5.

Figure 5:
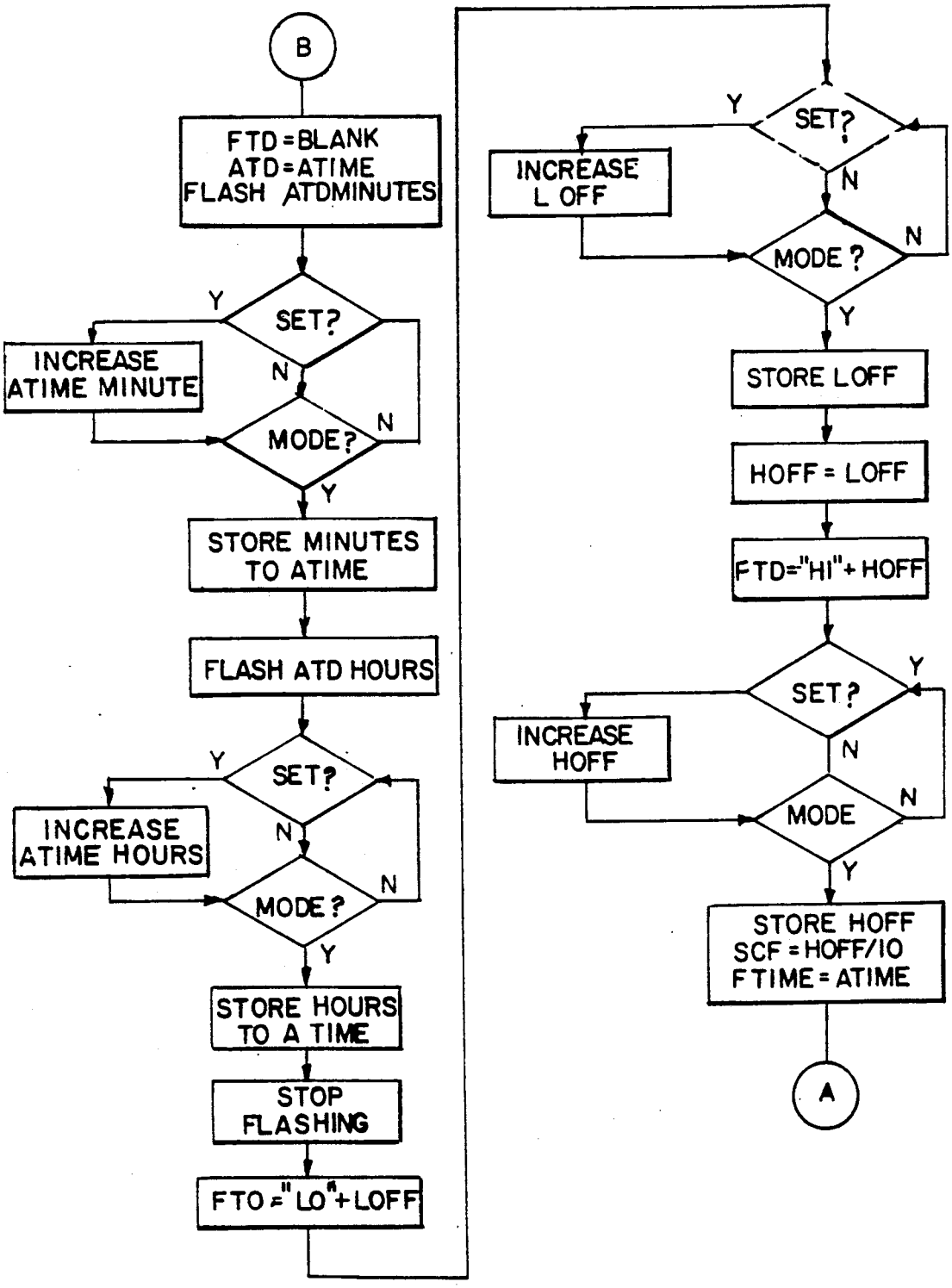

Referring now to FIG. 5, with the intention of returning to FIG. 4, the setting is performed as follows. The microprocessor 119 blanks FTD 117 and displays ATIME on ATD 118. The microprocessor 119 causes the minutes portion of the ATD to flash. Then the microprocessor 119 tests the status of the set switch 114. If the set switch 114 is actuated, then the minutes shown on the ATD 118 is increased by one and the mode switch is tested. If the set switch 114 is not actuated, the mode switch 113 is tested directly. If the mode switch 113 is not actuated, testing of the set switch 114 and mode switch 113 continues until the mode switch 113 is actuated, at which time the ATIME is updated to reflect the minutes shown on ATD 118, the minutes digits cease flashing, and the hours digits begin to flash. In a like manner, the set switch 114 and mode switch 113 are used to set the hours. Upon actuation of the mode switch 113 again, the newly set hours are stored to ATIME, the ATD 118 stops flashing,and the user has completed setting the actual time into the memory. The microprocessor then displays the word "LO" in the hours place of the FTD 117, and the current value of LOFF on the minutes place of FTD 117. As before, the set switch 114 and the mode switch 113 are tested. Actuation of the set switch 114 causes the value of LOFF to increase. Actuation of the mode switch 113 causes the new LOFF to be stored. The microprocessor 119 then sets the value of HOFF equal to the value of LOFF, displays the word "HI" in the hours place of FTD 117, and HOFF in the minutes place. The set switch 114 is used to increase the value of HOFF, with the microprocessor 119 never allowing the condition where HOFF is less than LOFF. When the mode switch 113 is actuated, the new value of HOFF is stored, and a new value for SCF is calculated as HOFF/10. FTIME is set equal to ATIME, and control returns to the main program. In this way the user has set the actual time, the lowest time offset desired, and the highest time offset desired.

Returning now to FIG. 4, the microprocessor 119 tests for actuation of time switch 115. If time switch 115 is actuated, ATD displays the actual time, and the microprocessor continues to test the time switch 115. In this way, the actual time is displayed for the user as long as the time switch 115 is depressed. When the time switch 115 is released, the ATD 118 is blanked, and WFLAG is tested to see whether it is set. The case in which WFLAG is set will be considered later in the description. For now WFLAG is not set, so the microprocessor 119 gets an offset number from a random table in the read-only memory 120. This offset number is then scaled using SCF to obtain an offset in minutes between LOFF and HOFF. This offset is then added to ATIME to obtain the next "fast" time, NFTIME. If NFTIME is the same as FTIME, then no change is required, and processing loops back to where the mode switch 13 is tested. If NFTIME is not the same as FTIME, WFLAG is set, and one of the two cases exists: NFTIME is larger or smaller than FTIME. If NFTIME is larger than FTIME, then the counting rate CR for FTIME is set to two so that FTIME can "catch up" to NFTIME by counting at a faster rate. The microprocessor 119 then begins a loop which tests whether NFTIME and FTIME have become the same. If they have not, control loops back to testing the mode switch 113 and continues until WFLAG is tested. When WFLAG is tested at this point, it is found to be set, and the microprocessor 119 again tests to see if NFTIME and FTIME have converged. This loop continues until NFTIME and FTIME are the same, at which point the count rate CR for FTIME is reset to one, WFLAG is reset to zero, and control returns to the main program at the mode switch 113 test. If NFTIME is less than FTIME, then counting rate CR for FTIME is set to 0.5 so that the lower offset between ATIME and NFTIME is achieved by FTIME because it counts at a slower rate. The microprocessor begins the same loop described above for the case where NFTIME is larger than FTIME until NFTIME and FTIME are the same, at which point the count rate CR for FTIME is reset to one, WFLAG is reset to zero, and control returns to the main program at the mode switch 113 test.

Operation of the main program loop of FIG. 4 continues until the mode test switch is actuated, and control branches to FIG. 5 as described above, or until power is removed from the unit.

A simple description of how the user operates this embodiment is as follows. The user presses the time switch 115 and determines if the time shown on the actual time display 118 is correct by comparing it to a known accurate clock or watch. If the time is not correct, the user proceeds to set the time by depressing the mode switch 113. With the minutes on the actual time display flashing, the user depresses the set switch 114 the required number of times to make the minutes displayed match the minutes of the correct time. The user then presses the mode switch 113 to the next function. The hour digits flash, and the user presses the set switch 114 to increment the digits to display the correct hour time. Again actuating the mode switch 113, the user has the opportunity to set the lowest time offset desired to be displayed on the "fast" time display 117 setting the minimum amount of time the "fast" time display 117 will be fast. The set switch 114 is used in the manner described above for setting the time entered as this value. Another actuation of the mode switch 113 allows entry of the highest time offset desired, that is the maximum amount of time the "fast" display 117 will be fast. One more actuation of the mode switch 113 returns the device to its normal operation mode in which the actual time display 118 is blank, and the "fast" time display 117 shows a time randomly fast between the lowest desired and highest desired amounts of fastness. This amount of fastness changes with time but is always within the range specified by the user. At any time, the user may press the time switch 115, and the actual time display 118 will display the actual time for as long as the user depresses the switch. The user can elect to make the timepiece function as a standard wristwatch by setting both the high and low offsets to zero.

SUMMARY, RAMIFICATIONS, AND SCOPE

Accordingly, the reader will see that the randomly self-advancing timepiece has the advantage of having a continuous display of a time that is fast, and a momentarily activated display with the actual time. In addition, the randomly self-advancing advancing timepiece has the advantages of:

- a continuous display being fast by an amount from within a user-specified range;
- having the fastness of the continuous display being randomly selected from the user-specified range;
- having the fastness of the continuous display vary over time within the user-specified range;
- allowing an habitually tardy person to be more punctual when the user specifies the minimum of the range as the amount of time by which the user is generally tardy;
- not allowing the user to consciously or unconsciously correct the continuously displayed fast time because the user cannot be sure how fast the continuous display is.

Although the description above contains many specificities, these should not be construed as limiting the scope of the invention, but merely providing illustration of some of the presently preferred embodiments of this invention. For example, the displays can be of any type. The displays can be either analog or digital, and the displays can be of the same type or they can differ. Furthermore, in the case of digital displays, there need not be two separate displays. A single display can continuously show the fast time. When a user wishes to know the actual time, it can be momentarily displayed in the place of the fast time. Furthermore, the information displayed for the user to know the actual time does not need to be the actual time. It can be a display of the current amount of fastness that the continuous display is showing. Also, the housing of the invention is not restricted to a wristwatch. The invention can be housed in an alarm clock, a desk clock, a wall clock, or any timepiece.

Thus the scope of the invention should be determined by the appended claims and their legal equivalents, rather than by the examples given.

I claim:

1. A timepiece, the improvements therein comprising:

a time standard;

an actual time specifying means for specifying the actual time;

a data storage means for storing data representing a range of time intervals;

a time interval specifying means for specifying a range of time intervals;

a microprocessing means operably associated with said time standard, said actual time specifying means, said data storage means, and said time interval specifying means for continuously calculating the actual time, and calculating a fast time equal to the actual time plus a randomly retrieved time interval from within the range of time intervals stored as data in said data storage means;

a microprocessor function specifying means operably associated with said microprocessing means for specifying the operating function of the microprocessor;

a continuous time displaying means operably associated with said microprocessing means for displaying a fast time;

a second displaying means operably associated with said microprocessing means for momentarily displaying information to know the actual time;

a display activating means operably associated with said microprocessing means for activating said second displaying means;

a time base means operable within said microprocessing means for timing a period after which said microprocessing means causes said continuous time displaying means to display a new fast time equal to the actual time plus a new and different time interval retrieved from the range of stored intervals, whereby said continuous time displaying means displays a time that is fast and varies within the time interval range stored in said data storage means, and varies within a period determined by said time base means.

2. The timepiece of claim 1 wherein said timepiece is a wristwatch.

3. The timepiece of claim 1 wherein said timepiece is an alarm clock.

4. The timepiece of claim 1 wherein said second displaying means, upon actuation of said display activating means, momentarily displays the amount of time that the current fast time is ahead of the actual time.

5. The timepiece of claim 1 wherein said second displaying means, upon actuation of said display activating means, momentarily displays the actual time.

6. A timepiece, the improvements therein comprising:

a time standard;

an actual time specifying means for specifying the actual time;

a data storage means for storing data representing a range of time intervals;

a time interval specifying means for specifying a range of time intervals;

a microprocessing means operably associated with said time standard, said actual time specifying means, said data storage means, and said time interval specifying means for continuously calculating the actual time, and calculating a fast time equal to the actual time plus a randomly retrieved time interval from within the range of time intervals stored as data in said data storage means;

a microprocessor function specifying means operably associated with said microprocessing means for specifying the operating function of the microprocessor;

a displaying means operably associated with said microprocessing means that has two modes, one for continuously displaying a fast time, and one for momentarily displaying information to know the actual time;

a display mode selecting means operably associated with said microprocessing means for selecting the display mode of the displaying means;

a time base means operable within said microprocessing means for timing a period after which said microprocessing means causes said continuous time displaying means to display a new fast time equal to the actual time plus a new and different time interval retrieved from the range of stored intervals, whereby said continuous time displaying means displays a time that is fast and varies within the time interval range stored in said data storage means, and varies within a period determined by said time base means.

7. The timepiece of claim 6 wherein said timepiece is a wristwatch.

8. The timepiece of claim 6 wherein said timepiece is an alarm clock.

9. The timepiece of claim 6 wherein said displaying means continuously displays a fast time, and momentarily displays the amount of time that the current fast time is ahead of the actual time.

10. The timepiece of claim 9 wherein said timepiece is a wristwatch.

11. The timepiece of claim 9 wherein said timepiece is an alarm clock.

12. The timepiece of claim 6 wherein said displaying means continuously displays a fast time, and momentarily displays the actual time.

13. The timepiece of claim 12 wherein said timepiece is a wristwatch.

14. The timepiece of claim 12 wherein said timepiece is an alarm clock.

15. A timepiece, the improvements therein comprising:

a time standard;

an actual time specifying means for specifying the actual time;

a data storage means for storing data representing a range of time intervals;

a time interval specifying means for specifying a range of time intervals;

a microprocessing means operably associated with said time standard, said actual time specifying means, said data storage means, and said time interval specifying means for continuously calculating the actual time, and calculating a fast time equal to the actual time plus a randomly retrieved time interval from within the range of time intervals stored as data in said data storage means;

a microprocessor function specifying means operably associated with said microprocessing means for specifying the operating function of the microprocessor;

an analog time displaying means operably associated with said microprocessing means for displaying a fast time;

a digital displaying means operably associated with said microprocessing means for momentarily displaying information to know the actual time;

a digital display activating means operably associated with said microprocessing means for activating said digital displaying means;

a time base means operable within said microprocessing means for timing a period after which said microprocessing means causes said analog time displaying means to display a new fast time equal to the actual time plus a new and different time interval retrieved from the range of stored intervals, whereby said continuous time displaying means displays a time that is fast and varies within the time interval range stored in said data storage means, and varies within a period determined by said time base means.

16. The timepiece of claim 15 wherein said timepiece is a wristwatch.

17. The timepiece of claim 15 wherein said timepiece is an alarm clock.

18. The timepiece of claim 15 wherein said digital means, upon activation of said digital display activating means, momentarily displays the amount of time that the current fast time is ahead of the actual time.

19. The timepiece of claim 18 wherein said timepiece is a wristwatch.

20. The timepiece of claim 19 wherein said timepiece is an alarm clock.

* * * * *